US010388216B2

(12) United States Patent
Park et al.

(10) Patent No.: US 10,388,216 B2
(45) Date of Patent: Aug. 20, 2019

(54) DISPLAY DEVICE AND METHOD OF DRIVING THE SAME

(71) Applicant: SAMSUNG DISPLAY CO., LTD., Yongin-si, Gyeonggi-do (KR)

(72) Inventors: Jung Kook Park, Yongin-si (KR); Ju Gon Seok, Yongin-si (KR); Min Tak Lee, Yongin-si (KR); Sang Min Lim, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 300 days.

(21) Appl. No.: 15/367,531

(22) Filed: Dec. 2, 2016

(65) Prior Publication Data

US 2017/0162127 A1 Jun. 8, 2017

(30) Foreign Application Priority Data

Dec. 2, 2015 (KR) ..... 10-2015-0170698

(51) Int. Cl.
*G09G 3/3233* (2016.01)

(52) U.S. Cl.
CPC ... *G09G 3/3233* (2013.01); *G09G 2300/0417* (2013.01); *G09G 2320/0233* (2013.01); *G09G 2320/0257* (2013.01); *G09G 2320/103* (2013.01)

(58) Field of Classification Search
CPC ... G09G 2320/0257; G09G 2320/0233; G09G 3/3233
See application file for complete search history.

(56) References Cited

U.S. PATENT DOCUMENTS 5,717,421 A * 2/1998 Katakura ..... G09G 3/36 345/100
2014/0092070 A1* 4/2014 Kim ..... G09G 3/3614 345/209
2015/0015557 A1* 1/2015 Kim ..... G09G 3/2022 345/211
2015/0279274 A1* 10/2015 Pyo ..... G09G 3/3233 345/77
2016/0351115 A1* 12/2016 Bang ..... G09G 3/2003

FOREIGN PATENT DOCUMENTS

KR 10-2015-0007057 A 1/2015

* cited by examiner

*Primary Examiner* — Amr A Awad
*Assistant Examiner* — Maheen I Javed
(74) *Attorney, Agent, or Firm* — Lee & Morse, P.C.

(57) ABSTRACT

A display device includes an image controller that analyzes first image data to determine whether a same image is displayed for no less than a predetermined threshold time. The image controller sets a low grayscale region having grayscale values of no more than a predetermined threshold low grayscale value when the same image is displayed for no less than a threshold time. The image controller then receives second image data and transmits a control signal to allow a transistor hysteresis reset signal to be transmitted to pixels of the display in the low grayscale region. A data driver transmits the transistor hysteresis reset signal to the pixels in the low grayscale region based on the control signal.

17 Claims, 4 Drawing Sheets

DISPLAY DEVICE AND METHOD OF DRIVING THE SAME

CROSS-REFERENCE TO RELATED APPLICATION

Korean Patent Application No. 10-2015-0170698, filed on Dec. 2, 2015, and entitled, "Display Device and Method of Driving the Same," is incorporated by reference herein in its entirety.

BACKGROUND

1. Field

One or more embodiments described herein relate to a display device and a method for driving a display device.

2. Description of the Related Art

A variety of displays have been developed. Examples include liquid crystal displays, plasma display panels, and organic light emitting displays. Efforts are being made to improve the size and resolution of these displays. However, this may increase the amount and speed of data to be transmitted, which, in turn, may present problems.

One problem is referred to as a shadow effect. This occurs when the brightness components of pixels that continuously emit light differ from the brightness components of pixels that do not emit light and then emit light. For example, a display may include a first region having pixels that emit light and a second region adjacent to the first display region having pixels that are in a non-emission state for a relatively long time. When both the first and second display regions change to be in emission states, an instantaneous latent image may be generated. The latent image may be, for example, one in which a boundary is visible between the first and second display regions. Such an effect may adversely affect display quality.

SUMMARY

In accordance with one or more embodiments, a display device includes a display including a plurality of pixels; an image controller to analyze first image data to determine whether a same image is displayed for no less than a predetermined threshold time, to set a low grayscale region having grayscale values of no more than a predetermined threshold low grayscale value when the same image is displayed for no less than a threshold time, to receive second image data, and to transmit a control signal to allow a transistor hysteresis reset signal to be transmitted to pixels of the display in the low grayscale region; and a data driver to transmit the transistor hysteresis reset signal to the pixels in the low grayscale region based on the control signal.

The image controller may count a number of vertical synchronizing signals, and when the number of vertical synchronizing signals is no less than the number of predetermined threshold vertical synchronizing signals, determine that the same image is displayed for no less than the threshold time. The image controller may include a counter to count the number of vertical synchronizing signals.

When the same image is displayed for no less than the threshold time, the controller may set a high grayscale region having grayscale values of no less than a predetermined threshold high grayscale value, and the controller may receive second image data and transmit a control signal to the data driver to allow a transistor hysteresis reset signal to be transmitted to pixels of the display unit in the high grayscale region. The image controller may determine the pixels in the low grayscale region having grayscale values of no more than a predetermined threshold low grayscale for no less than the threshold time.

The data driver may determine whether a predetermined output time has passed, and when the predetermined output time has not passed, the data driver may transmit the transistor hysteresis reset signal to pixels in the low grayscale region. The image controller may analyze grayscale values of an image displayed in a region in which the same image is displayed for no less than the threshold time, and set a region in which displays the image having the grayscale values of no more than the threshold low grayscale value as the low grayscale region.

The image controller may include a first image processor to analyze the first image data to determine whether the same image is displayed for no less than the predetermined threshold time; a second image processor to set a low grayscale region displaying an image having grayscale values of no more than the predetermined threshold low grayscale for no less than the threshold time, when the same image is displayed for no less than the threshold time; and a third image processor to transmit the control signal to the data driver to allow the transistor hysteresis reset signal to be transmitted to pixels in the low grayscale region. The image controller may include a memory to store the threshold time, the threshold low grayscale, and the first image data. The data driver may transmit the transistor hysteresis reset signal to random ones of the pixels in the low grayscale region based on the control signal.

In accordance with one or more other embodiments, a method for driving a display device includes receiving first image data; analyzing the first image data to determine whether a same image is displayed for no less than a predetermined threshold time; when the same image is displayed for no less than the threshold time, setting a low grayscale region displaying an image having grayscale values of no more than a predetermined threshold low grayscale value for no less than the threshold time; receiving second image data; and transmitting a control signal to control transmission of a transistor hysteresis reset signal to pixels in the low grayscale region.

Determining whether the same image is displayed for no less than a predetermined threshold time may include counting a number of vertical synchronizing signals; and determining that the same image is displayed for no less than the threshold time when the number of vertical synchronizing signals is no less than a predetermined number. The method may include setting a high grayscale region displaying an image having grayscale values of no less than a predetermined threshold high grayscale for no less than the threshold time, when the same image is displayed for no less than the threshold time; and transmitting a transistor hysteresis reset signal to pixels in the high grayscale region.

Setting the low grayscale region may include determining pixels in the low grayscale region in which an image having grayscale values of no more than a predetermined threshold low grayscale is displayed for no less than the threshold time. Transmitting of the transistor hysteresis reset signal may include determining whether a predetermined output time has passed; and transmitting the transistor hysteresis reset signal to pixels in the low grayscale region when the predetermined output time has not passed. Setting the low grayscale region may include analyzing grayscale values of an image displayed in a region in which the same image is displayed for no less than the threshold time; and setting a region in which an image having grayscale values of no more than the threshold low grayscale is displayed as a low grayscale region. The method may include transmitting the transistor hysteresis reset signal to random ones of the pixels in the low grayscale region.

In accordance with one or more other embodiments, an apparatus includes an interface and an image controller to identify a first grayscale region when a same image is output on a display for at least a predetermined time and to transmit a signal through the interface to control transmission of a transistor hysteresis reset signal to pixels in the first grayscale region, wherein the first grayscale region includes pixels that emit light with grayscale values in a first grayscale range. The image controller may identify a second grayscale region including pixels that emit light in a second grayscale range when the same image is output on the display for at least the predetermined time.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
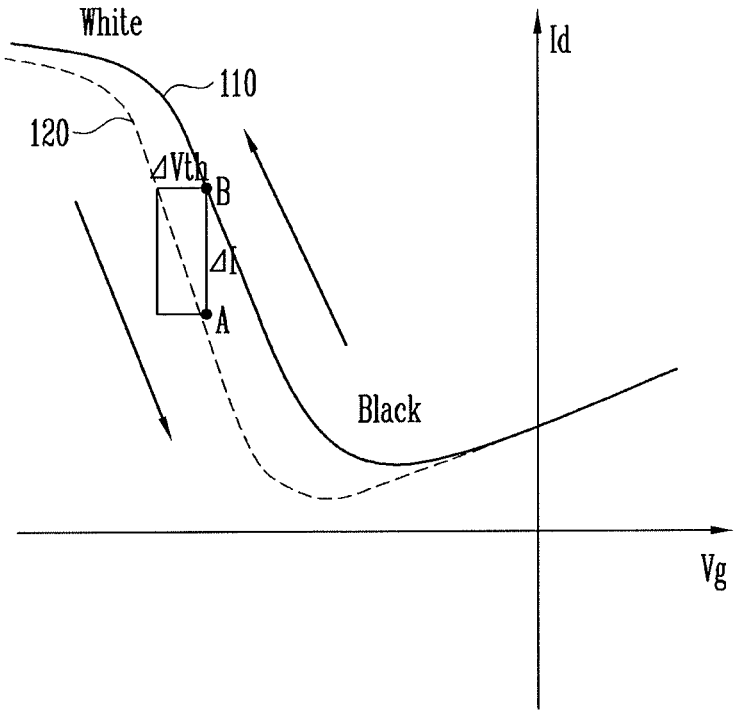
FIG. 1 illustrates an example of a hysteresis characteristic of a driving transistor.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When one element is referred to as being "connected to" or "coupled to" another element, it may be connected directly to or coupled directly to another element or be connected to or coupled to another element, having the other element intervening therebetween. In addition, in the following description, and the word 'including' does not preclude the presence of other components and means that an additional component is included in the technical concept of the present invention.

Terms such as 'first', 'second', etc., may be used to describe various components, but the components are not to be construed as being limited to the terms. The terms are used only to distinguish one component from another component. For example, the 'first' component may be named the 'second' component and the 'second' component may also be similarly named the 'first' component, without departing from the scope of the present invention.

Also, elements of the embodiments of the present invention are independently illustrated to show different characteristic functions, and it does not mean that each element is configured as separated hardware or a single software component. Namely, for the sake of explanation, respective elements are arranged to be included, and at least two of the respective elements may be incorporated into a single element or a single element may be divided into a plurality of elements to perform a function, and the integrated embodiment and divided embodiment of the respective elements are in the scope of the present invention unless it diverts from the essence of the present invention.

Also, some of the elements may be optional to merely enhance the performance, rather than being essential to perform a constitutional function. The present invention may be implemented by using only the elements requisite for implement the essence of the present invention, excluding elements used to merely enhance the performance, and a structure including only the essential elements excluding the optional elements merely used to enhance the performance is also included in the scope of the present invention.

In describing embodiments of the present invention, a detailed description of known techniques associated with the present invention unnecessarily obscures the gist of the present invention, it is determined that the detailed description thereof will be omitted. Moreover, the terms used henceforth have been defined in consideration of the functions of the present invention, and may be altered according to the intent of a user or operator, or conventional practice. Therefore, the terms should be defined on the basis of the entire content of this specification.

FIG. 1 is a graph illustrating an example of the hysteresis characteristic of a transistor which, for example, may representative of the pixel driving transistors in a display device. Referring to FIG. 1, when a pixel in the display unit of a display device (e.g., an organic light emitting diode (OLED) device) continuously emits light, the driving transistor of the pixel may have a first voltage-current characteristic 120. When the pixel does not continuously emit light, the driving transistor of the pixel may have a second voltage-current characteristic 110.

From a comparison of these characteristics, it is evident that the brightness of light emitted from a pixel having a driving transistor with the first voltage-current characteristic 120 is different from brightness of light emitted from a pixel having a driving transistor with the second voltage-current characteristic 110. As a result, a shadow effect may occur. For example, when a first display region including pixels with the first voltage-current characteristic 120 is adjacent to a second display region including pixels with the second voltage-current characteristic 110 and when the first and second display regions change to emission states, an instantaneous latent image (e.g., a boundary between the first and second display regions) may be visibly generated as a result of the difference voltage-current characteristics of the driving transistors.

As illustrated by the hysteresis characteristic of the driving transistor in FIG. 1, current Id changes with changes in gate voltage Vg. For example, when the brightness of light emitted from a pixel changes from a high (e.g., white) grayscale value to an intermediate grayscale value in accordance with the first voltage-current characteristic 120, the absolute value |Vg| of the gate voltage Vg of the driving transistor changes from a large value to a small value. Since the gate voltage Vg having a larger absolute value |Vg| at a high grayscale value was previously applied to the driving transistor, the current Id of the driving transistor may be the same as the current value at point A, when the gate voltage Vg corresponding to the intermediate grayscale value is applied to the driving transistor and as the threshold voltage |Vth| of the driving transistor increases.

When the brightness of light emitted from the pixel changes from a low (e.g., a black) grayscale value to an intermediate grayscale value in accordance with the second voltage-current characteristic 110, the absolute value |Vg| of the gate voltage Vg of the driving transistor changes from a small value to a large value. Since the gate voltage Vg having a smaller absolute value |Vg| at the low grayscale value was previously applied to the driving transistor, the current Id of the driving transistor may be the same as the current value at point B, when the gate voltage Vg corresponding to the intermediate grayscale value is applied to the driving transistor and when the threshold voltage |Vth| of the driving transistor is reduced by ΔVth, Therefore, because of the hysteresis characteristic of the driving transistor, current flowing through the display device may vary in accordance with the previous brightness of light emitted from a corresponding pixel. This may occur even when the same gate voltage Vg is applied to the driving transistor to display light with a brightness corresponding to an intermediate grayscale value.

For example, consider the case where a gate voltage Vg is applied to a pixel that previously displayed light with a brightness corresponding to an intermediate grayscale value. If, in a next frame, the pixel is to emit light of a high grayscale value, the current of the driving transistor may have a first value. However, if, in the next frame the pixel is to emit light of a low grayscale value, the current of the driving transistor may have a second value. The difference in these currents ΔI, as illustrated, for example, in FIG. 1, may generate a screen latent image.

As described above, an instantaneous latent image may therefore be generated as a result of the hysteresis characteristics of the driving transistors of pixels in a display device. In an attempt to prevent the instantaneous latent image from being generated, a method may be applied to control the thickness of the gate insulator of the transistor in a manufacturing process. This method may involve controlling the annealing temperature of a carbon nanotube (CNT) or inserting black data every frame or every sub-frame of the frame to transmit data.

However, in a p-type thin film transistor (TFT), there are limitations on reducing transistor hysteresis. For example, the method of inserting black data every frame or every sub-frame or of using of an impulse driving method may generate flicker, which reduces display quality. Since the data voltage of a driving transistor remains changed, any reduction that might be achieved concerning the instantaneous latent image is small at best. Also, power consumption is increased and the life span of the display device may be reduced through these methods.

Figure 2:
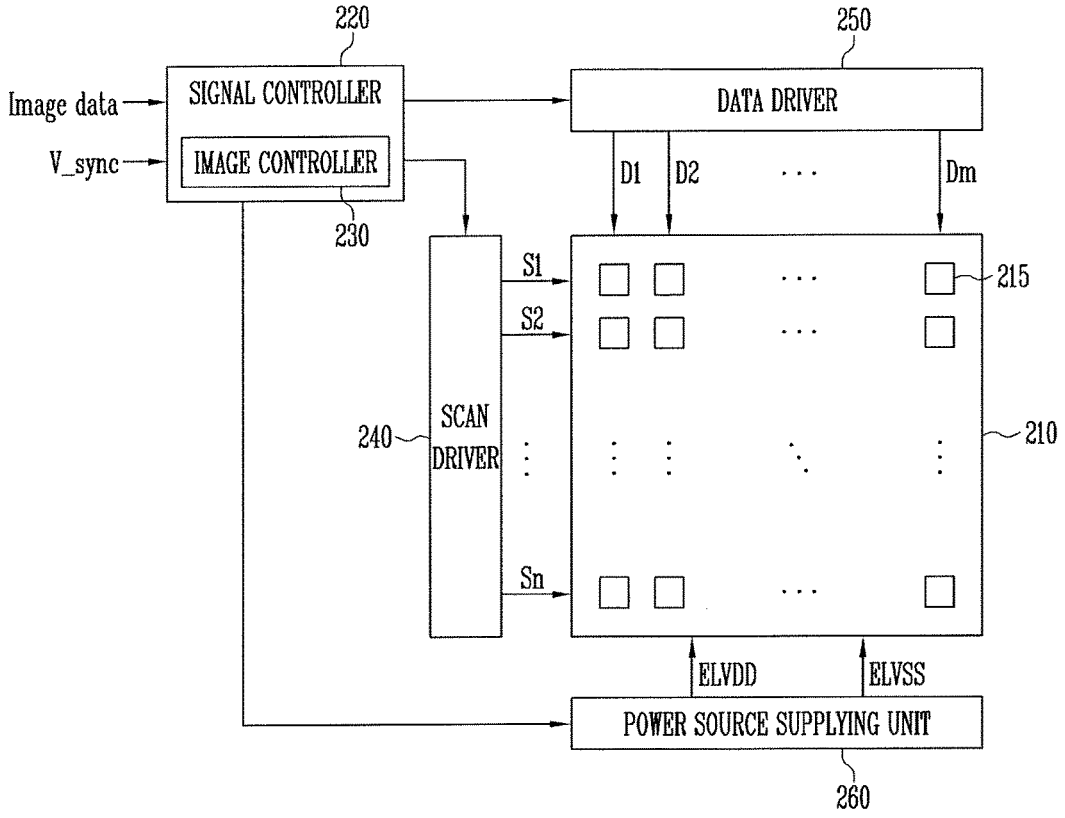
FIG. 2 illustrates an embodiment of a display device.

FIG. 2 illustrates an embodiment of a display device which includes a display unit 210 including a plurality of pixels 215, a scan driver 240 for transmitting a plurality of scan signals to the display unit 210, a data driver 250 for transmitting a plurality of data signals to the display unit 210, a power source supplying unit 260 for supplying driving voltages (e.g., a first power source voltage ELVDD and a second power source voltage ELVSS) to the display unit 210, and a signal controller 220 for supplying a plurality of control signals for controlling the scan driver 240, the data driver 250, and the power source supplying unit 260. The display device may also include an image controller 230. In FIG. 2, the image controller 230 is in the signal controller 220. However, the image controller 230 may be separate from the signal controller 220 in another embodiment.

The display unit 210 includes the pixels 215 arranged in a matrix. The pixels 215 emit light components based on driving currents that correspond to respective data signals from the data driver 250. The pixels 215 may include, for example, organic light emitting diodes (OLEDs), and the display device may be categorized based on the driving method of the OLEDs, e.g., the display device may be a passive matrix organic light emitting display device (PMOLED) or an active matrix OLED (AMOLED). For illustrative purposes, the display device in this embodiment is an AMOLED.

The display unit 210 also includes a plurality of scan lines S1 to Sn arranged in a first (e.g., row) direction for transmitting scan signals from the scan driver 240 and a plurality of data lines D1 to Dm arranged in a second (e.g., column) direction to transmit data signals from the data driver 250. For example, the pixel 215 in a jth pixel row and a kth pixel column may be connected to a scan line Sj and data line Dk. The scan driver 240 may be implemented by a plurality of drivers in another embodiment.

Each pixel 215 includes a pixel circuit for supplying a current to an OLED in accordance with a corresponding data signal. The OLED emit lights with predetermined brightness based on the supplied current. The first power source voltage ELVDD and the second power source voltage ELVSS may be transmitted from the power source supplying unit 260 to generate emission of light.

The scan driver 240 transmits scan signals to corresponding ones of the scan lines S1 to Sn. The scan driver 240 transmits the scan signals in accordance with a scan driving control signal from the signal controller 220.

The data driver 250 generates data signals based on image data received by the signal controller 220. The data signals are transmitted to respective ones of the data lines D1 to Dm connected to the display unit 210. The data driver 250 may be driven by a data driving control signal from the signal controller 220.

The signal controller 220 may receive timing signals such as a horizontal synchronizing signal, a vertical synchronizing signal V_sync, a data enable signal De, and a dot clock CLK. The control signals to be respectively transmitted to the data driver 250, the scan driver 240, and the power source supplying unit 260 may be generated based on the received signals.

The probability of generating an instantaneous latent image may increase in proportion to the time a same image is displayed by the display unit 210. Therefore, according to one embodiment, the image controller 230 may monitor the time the same image is displayed, for example, starting with at a time the instantaneous latent image is recognized. The image controller 230 may monitor the display duration time of the same image, for example, by counting the number of vertical synchronizing signals V_sync.

In one embodiment, the image controller 230 determines whether the same image continues for no less than a predetermined threshold time. When the same image is displayed for no less than the threshold time, the image controller 230 may determine that the same image is displayed for a long time. At this time, according to one embodiment, the image controller 230 may determine whether the number of vertical synchronizing signals V_sync is greater than the number of predetermined threshold vertical synchronizing signals. The threshold time and/or number of threshold vertical synchronizing signals may be stored in a memory of the display device.

An instantaneous latent image may be generated, for example, when the display device switches from displaying a low grayscale image to a high grayscale image, e.g., a bright image. For example, an instantaneous latent image may be generated when a black image is displayed for a long time and then a white image is displayed. The image controller 230 may set a region in which the low grayscale image is displayed in the display unit 210 for a long time. Then, the image controller 230 may transmit a control signal for allowing a transistor hysteresis reset signal to be output only to pixels in a region in which the low grayscale image is displayed for a long time. The control signal may be transmitted, for example, to the data driver 250. The hysteresis reset signal may be output to the pixels in a predetermined manner or a random manner.

When the data driver 250 receives the control signal, the data driver 250 may output the transistor hysteresis reset signal for a predetermined or random output time. The transistor hysteresis reset signal may be, for example, black data or low grayscale data corresponding to the black data.

When a high grayscale image is displayed for a long time and then a low grayscale image is displayed, an instantaneous latent image may be generated in accordance with the characteristics of the pixels. At this time, the image controller 230 may set a region in which the high grayscale image is displayed for a long time. The image controller 230 may transmit a control signal for allowing a transistor hysteresis reset signal to be output only to pixels in the region in which the high grayscale image is displayed for a long time. The control signal may be received by the data driver 250, and the data driver 250 may output the transistor hysteresis reset signal for a predetermined or random output time. Also, the hysteresis reset signal may be output to the pixels in a predetermined manner or a random manner.

In one embodiment, the image controller 230 may select the pixels to which the transistor hysteresis reset signal is to be transmitted in a manner that varies, for example, in accordance with pixel characteristics. For example, when a large amount of instantaneous latent image is generated at the moment when a low grayscale image is displayed for a long time and then a high grayscale image is displayed in the pixels of the display device, the image controller 230 may set a region in which the low grayscale image is displayed in the display unit 210 for a long time.

When the grayscale values of an image are no more than a predetermined threshold low grayscale value, the image controller 230 may determine the image as a low grayscale image. When the grayscale values of the image are no more than a predetermined threshold high grayscale value, the image controller 230 may determine the image as a high grayscale image. The threshold low grayscale value and/or the threshold high grayscale value may be stored in the memory of the display device.

According to an embodiment, the scan driver 240, the data driver 250, the signal controller 220, and the image controller 230 may be implemented in one display driver IC as hardware. The pixels 215 in the display unit 210 receive corresponding scan signals and allow OLEDs to emit light components based on data voltages that correspond to the data signals to display an image.

Figure 3:
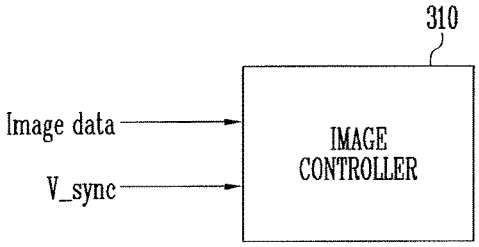
FIG. 3 illustrates an embodiment of an image controller.
Figure 4:
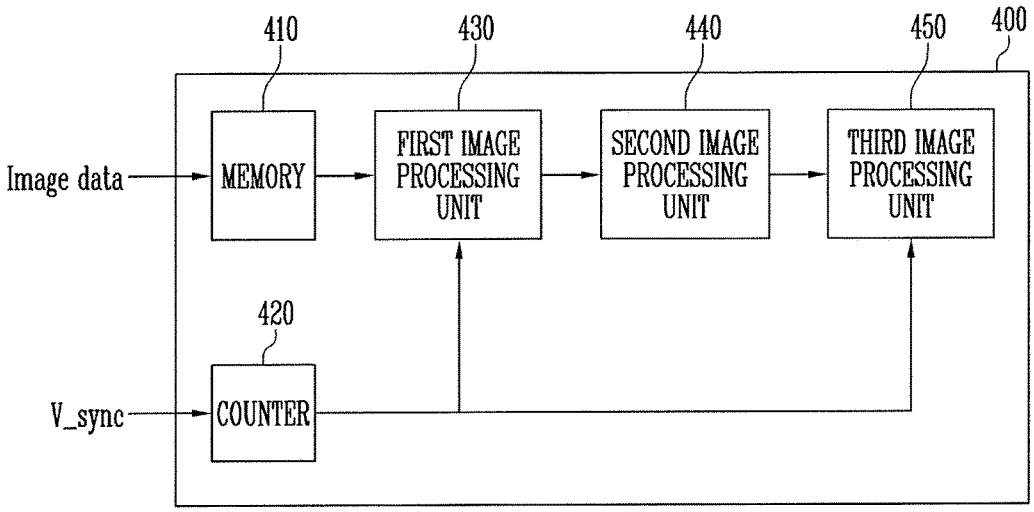
FIG. 4 illustrates another embodiment of an image controller.

FIG. 3 illustrates an embodiment of an image controller 310, which, for example, may correspond to the image controller in FIG. 2. FIG. 4 illustrates another embodiment of an image controller 400, which, for example, may correspond to the image controller in FIG. 2.

Referring to FIG. 3, the image controller 310 may receive image data. When the input image data is input to a driving controller (or a timing controller), the image controller 310 may analyze distribution of the input image data. For example, the image controller 310 may analyze image data input, in units of pixels or specific blocks of a display unit, in order to determine whether the same image data is continuously input to a specific region of the display unit. For convenience sake, the input image data may be referred to as first image data.

When it is determined that the same image is continuously input to a specific pixel or block of the display unit, the image controller 310 may monitor the time the same image is displayed. According to an embodiment, the image controller 310 receives the vertical synchronizing signals V_sync and counts the number of received vertical synchronizing signals V_sync to monitor a display time of a fixed image. When new image data is received, the image controller 310 may start to count the number of vertical synchronizing signals V_sync. The image controller 310 counts the number of vertical synchronizing signals V_sync to monitor the display time of the same image.

When the same image is displayed for no less than a predetermined threshold time, the image controller 310 may determine that the image is displayed for a long time. In addition, according to one embodiment, when the number of vertical synchronizing signals V_sync is no less than the number of predetermined threshold vertical synchronizing signals V_sync, the image controller 310 may determine that the fixed image is displayed for a long time.

When it is determined that the same image is displayed for a long time, the image controller 310 may set a low grayscale region (in which a low grayscale image is displayed in the display unit) for a long time. At this time, the image controller 310 analyzes a grayscale of an image displayed in a region in which the image is displayed for a long time to determine an image having grayscale values of no more than a predetermined threshold low grayscale.

The image controller 310 may set a region (in which an image having grayscale values of no more than the threshold low grayscale is displayed for a long time) as a low grayscale region. In addition, the image controller 310 may determine pixels of the display unit in the low grayscale region.

For example, as described above, the image controller 310 receives image data and analyzes the received image data in units of pixels or specific block units of the display unit in order to determine whether the same image data is input to a specific region of the display unit. When it is determined that the same image data is input to the specific region of the display unit, the image controller 310 determines whether the same image data continues for no less than a threshold time, in order to determine whether the image is displayed for a long time. When it is determined that the image is displayed for a long time, the image controller 310 may determine a region in which image data, having grayscale values of no more than a predetermined threshold low grayscale value, is displayed in the specific region of the display unit in which the image is displayed for a long time. The image controller 310 may set the region in which the image data having the grayscale values of no more than the threshold low grayscale is displayed as a low grayscale region.

According to one embodiment, when it is determined that the image is displayed for a long time, the image controller 310 may set a high grayscale region in which a high grayscale image is displayed in the display unit for a long time. At this time, the image controller 310 analyzes grayscale values of an image displayed in the region in which the fixed image is displayed for a long time to determine an image having grayscale values of no less than a predetermined threshold high grayscale. The image controller 310 may set the region, in which the image having the grayscale values of no less than the threshold high grayscale is displayed for a long time, as a high grayscale region. In addition, the image controller 310 may determine pixels of the display unit in the high grayscale region.

Whether the image controller 310 sets the low grayscale region or the high grayscale region may vary in accordance with pixel characteristics. For example, when a large amount of instantaneous latent image is generated at the moment when the low grayscale image is displayed for a long time, and then the high grayscale image is displayed in the pixels of the display device, the image controller 310 may set a low grayscale region in which the low grayscale image is displayed in the display unit for a long time. When a large amount of instantaneous latent image is generated at the moment when the high grayscale image is displayed for a long time, and then the low grayscale image is displayed in the pixels of the display device, the image controller 310 may set a high grayscale region in which the high grayscale image is displayed in the display unit for a long time.

Then, the image controller 310 may receive new image data when the predetermined uniform time lapses. The predetermined uniform time may be, for example, a changeable value. The new image data may be considered second image data.

When the second image data is analyzed and displayed in the display unit, the image controller 310 may transmit a control signal, to the data driver, for allowing a transistor hysteresis reset signal to be output only to pixels of the display unit in the low grayscale region (or the high grayscale region). The hysteresis reset signal may be output in a predetermined or random manner. The image controller 310 may transmit the control signal for allowing the transistor hysteresis reset signal to be output for a predetermined random output time to the data driver. For example, the predetermined random output time may be set as ten seconds. In this case, the image controller 310 may transmit the control signal for allowing the transistor hysteresis reset signal to be randomly output to the pixels of the display unit in the low grayscale region in 600 frames corresponding to ten seconds to the data driver.

The image controller 310 may transmit a control signal to the data driver for allowing the transistor hysteresis reset signal to be output to a first pixel in the low grayscale region, for example, in a first frame, a ninth frame, and a $16^{th}$ frame, and for preventing the transistor hysteresis reset signal from being output to the first pixel in the low grayscale region, for example, in second to eighth frames, tenth to $15^{th}$ frames, and $17^{th}$ to $21^{st}$ frames.

The data driver that receives the control signal may output the transistor hysteresis reset signal to the first pixel. The image controller 310 may transmit a control signal to the data driver for allowing the transistor hysteresis reset signal to be output to a second pixel, for example, in the low grayscale region in the second frame, the seventh frame, and the $16^{th}$ frame, and for preventing the transistor hysteresis reset signal from being output to the second pixel in the low grayscale region, for example, in the first frame, the third to sixth frames, the eighth to $15^{th}$ frames, and $17^{th}$ to $25^{th}$ frames. The data driver that receives the control signal may output the transistor hysteresis reset signal to the second pixel in frames at least partially different from frames in which the transistor hysteresis reset signal is output to the first pixel. The transistor hysteresis reset signal may be output in a random or predetermined manner.

When the output time expires, the image controller 310 may transmit a control signal for allowing the display unit to perform common display to the data driver. The data driver may perform the common display after lapse of the random output time.

In FIG. 3, the image controller 310 is illustrated as one controller. However, as illustrated in FIG. 4, the image controller 400 may include a memory 410, a counter 420, a first image processing unit 430, a second image processing unit 440, and a third image processing unit 450.

The memory 410 may store image data received by the image controller 400. In addition, the memory 410 may store a program for controlling the entire operation of the image controller 400. The memory 410 may store a threshold time and/or the number of threshold vertical synchronizing signals for determining whether the same image is displayed for a long time, a threshold low grayscale and/or a threshold high grayscale for determining a low grayscale region or a high grayscale region, a predetermined uniform time for receiving new image data, and an output time for outputting a transistor hysteresis reset signal. The output time may be a predetermined or random output time for outputting the transistor hysteresis reset signal.

The counter 420 monitors a display duration time of the same image. The counter 420 may count the number of received vertical synchronizing signals V_sync to monitor the display time of a same image. When new image data is received, the counter 420 may start to count the number of vertical synchronizing signals V_sync. According to an embodiment, the counter 420 may calculate the display time of the image using the number of vertical synchronizing signals V_sync. Then, the counter 420 may transmit counting values of the vertical synchronizing signals V_sync or the display time of the image to the first image processing unit 430.

The first image processing unit 430 may determine whether a fixed image is displayed in a display unit for a long time. For this purpose, the first image processing unit 430 receives image data from the memory 410 and may receive the counting values of the vertical synchronizing signals V_sync from the counter 420. Then, when the input image data is input to a driving controller (or a timing controller), the first image processing unit 430 may analyze distribution of the input image data. For example, the first image processing unit 430 may analyze the input image data in units of pixels or specific blocks of the display unit.

Then, the first image processing unit 430 may determine whether the fixed image is displayed for a long time using the counting values of the vertical synchronizing signals V_sync or the display time of the image received from the counter 420. For example, to determine whether the fixed image is displayed for a long time, the first image processing unit 430 determines whether the display time of the image is no less than a predetermined threshold time or the counting values of the vertical synchronizing signals V_sync are no less than the number of predetermined threshold vertical synchronizing signals.

When it is determined by the first image processing unit 430 that the image is displayed for a long time, the second image processing unit 440 receives information thereon to set a low grayscale region in which a low grayscale image is displayed in the display unit for a long time. At this time, the second image processing unit 440 analyzes grayscale values of an image displayed in a region in which the image is displayed for a long time, in order to determine whether the image has grayscale values of no more than a predetermined threshold low grayscale. Then, the region in which the image having the grayscale values of no more than the threshold low grayscale is displayed for a long time may be set as a low grayscale region. The second image processing unit 440 may determine pixels of the display unit in the low grayscale region.

At this time, according to one embodiment, the second image processing unit 440 may set a high grayscale region (in which a high grayscale image is displayed in the display unit for a long time) in accordance with pixel characteristics.

With the predetermined uniform time elapses after second image data is received, the third image processing unit 450 may analyze the second image data. When the second image data is displayed in the display unit, the third image processing unit 450 may transmit to the data driver a control signal for allowing the transistor hysteresis reset signal to be transmitted to pixels of the display unit in the low grayscale region (or the high grayscale region) set by the second image processing unit 440. The transistor hysteresis reset signal may be transmitted in a predetermined or random manner.

In FIG. 4, the image controller 400 is illustrated as including separate image processing units 430, 440, and 450. However, in another embodiment, the first image processing unit 430, the second image processing unit 440, and the third image processing unit 450 may be in one image processing unit that performs operations of the first image processing unit 430, the second image processing unit 440, and the third image processing unit 450 or first image processing unit 430 may include counter 420.

In one embodiment, the counter 420, the first image processing unit 430, the second image processing unit 440, and the third image processing unit 450 may be implemented in one display driver IC as hardware.

Figure 5:
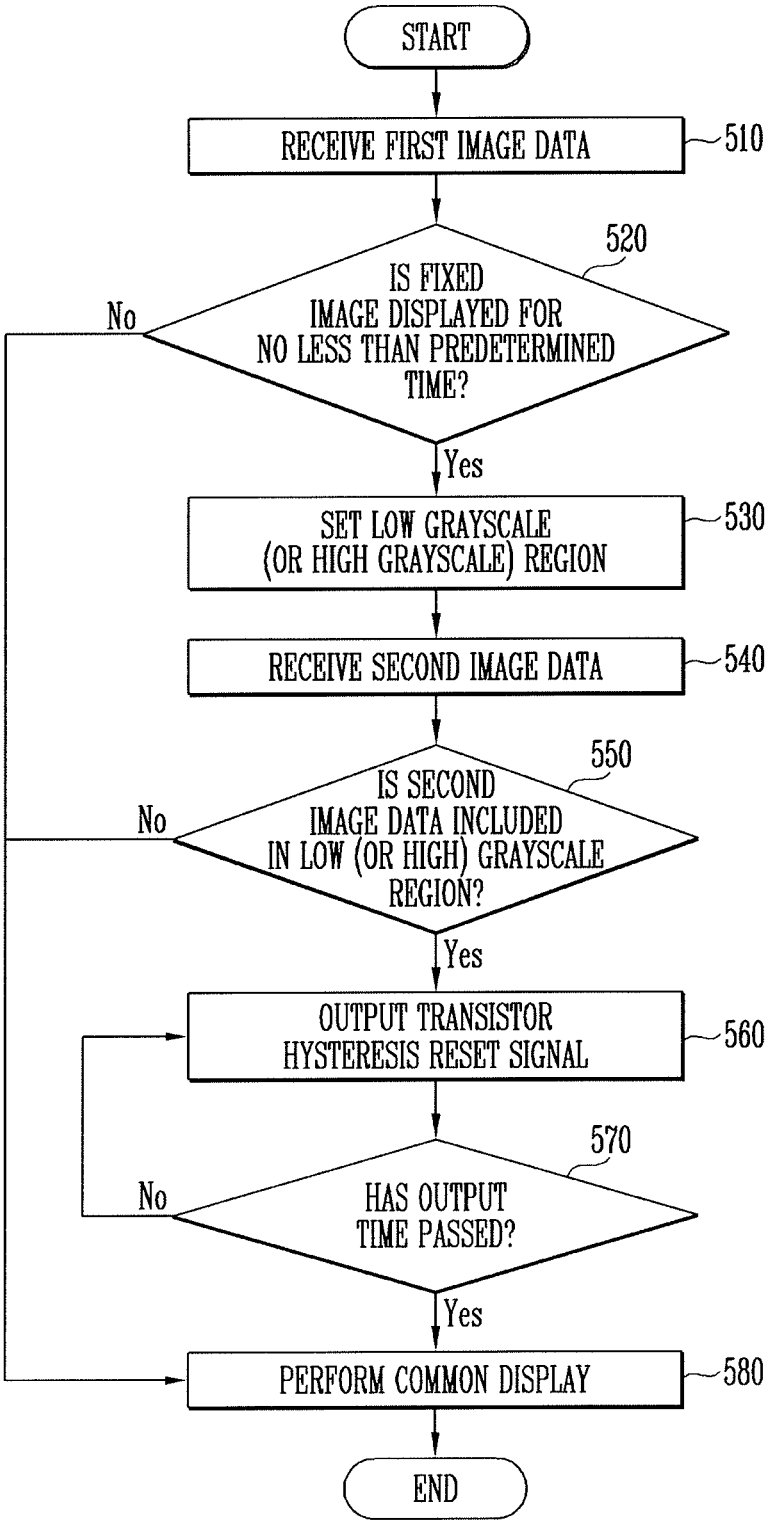
FIG. 5 illustrates an embodiment of a method for removing an instantaneous latent image in a display device.

FIG. 5 illustrates an embodiment of a method for removing an instantaneous latent image in a display device. The display device may be, for example, any of the aforementioned embodiments of the display device.

Referring to FIG. 5, an image controller may receive first image data in operation 510. Then, the image controller may determine whether a same image is displayed for no less than a predetermined threshold time, in operation 520. For example, the image controller analyzes the received image data in units of pixels or specific blocks of a display unit to determine whether the same image data is input to a specific region of the display unit.

When it is determined that the same image data is input to a specific pixel of the display unit, the image controller determines whether the same image data continues for no less than a threshold time, in order to determine whether the same image is displayed for a long time. According to an embodiment, the image controller may count the number of vertical synchronizing signals V_sync to monitor the display time of the same image, as previously described.

When it is determined, in operation 520, that the same image is displayed for less than a predetermined threshold time, the image controller may control the display unit to perform common display in operation 580. However, when it is determined, in operation 520, that display of the same image continues for no less than the predetermined threshold time, the image controller may set a low grayscale region in which a low grayscale image is displayed in the display unit for a long time, in operation 530. According to one embodiment, the image controller may set a high grayscale region in which a high grayscale image is displayed in the display unit for a long time, as previously described.

Then, the image controller may receive second image data in operation 540.

In operation 550, the image controller may analyze the second image data to determine whether the second image data is in the low grayscale region or the high grayscale region, as determined in operation 530, as previously described.

Then, in operation 560, the image controller may transmit a control signal to the data driver for allowing a transistor hysteresis reset signal to be output to pixels of the display unit in the low grayscale region (or the high grayscale region). The transistor hysteresis reset signal may be output in a predetermined or random manner. The data driver that receives the control signal may transmit the transistor hysteresis reset signal to the pixels of the display unit in the low grayscale region (or high grayscale region). This may be performed in a predetermined or random manner, as previously described.

In operation 570, the data driver determines whether a predetermined output time has passed. When it is determined that the output time has not passed, the data driver may transmit the transistor hysteresis reset signal to the pixels of the display unit in the low grayscale region (or the high grayscale region), in operation 560. This may be performed in a predetermined or random manner as previously described.

On the other hand, the image controller may control the data driver to perform common display, in operation 580, on pixels determined to be in a region that does not correspond to the low grayscale region or the high grayscale region in the second image data, in operation 550. Then, the data driver may perform common display on the pixels in the region that does not correspond to the low grayscale region or the high grayscale region in the second image data.

When it is determined in operation 570 that the output time has passed, the data driver may perform the common display in the operation 580.

In accordance with another embodiment, an apparatus includes an interface and an image controller to identify a first grayscale region when a same image is output on a display for at least a predetermined time and to transmit a signal through the interface to control transmission of a transistor hysteresis reset signal to pixels in the first grayscale region, wherein the first grayscale region includes pixels that emit light with grayscale values in a first grayscale range. The image controller may be any of the aforementioned embodiments of the image controller. The image controller may identify a second grayscale region including pixels that emit light in a second grayscale range when the same image is output on the display for at least the predetermined time, and may also perform other operations as described in relation to the previous embodiments.

The image controller may be embodied in an integrated circuit chip. The interface may be, for example, one or more output terminals, leads, wires, ports, signal lines, or other type of interface without or coupled to the driver. The image controller may be implemented in hardware (e.g., as described above) or software or both.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The drivers, controllers, processing units, and other processing or computation features of the embodiments disclosed herein may be implemented in logic which, for example, may include hardware, software, or both. When implemented at least partially in hardware, the drivers, controllers, processing units, and other processing or computation features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, processing units, and other processing or computation features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. A display device, comprising:

a display including a plurality of pixels;

an image controller to analyze first image data to determine whether a same image is displayed for no less than a predetermined threshold time, to set a low grayscale region having grayscale values of no more than a predetermined threshold low grayscale value when the same image is displayed for no less than a threshold time, to receive second image data, and to transmit a control signal to allow a transistor hysteresis reset signal to be transmitted to pixels of the display in the low grayscale region; and a data driver to transmit the transistor hysteresis reset signal to only random ones of the pixels in the low grayscale region based on the control signal.

2. The display device as claimed in claim 1, wherein the image controller is to:

count a number of vertical synchronizing signals, and when the number of vertical synchronizing signals is no less than a number of predetermined threshold vertical synchronizing signals, determine that the same image is displayed for no less than the threshold time.

3. The display device as claimed in claim 2, wherein the image controller includes a counter to count the number of vertical synchronizing signals.

4. The display device as claimed in claim 1, wherein:

when the same image is displayed for no less than the threshold time, the image controller is to set a high grayscale region having grayscale values of no less than a predetermined threshold high grayscale value, and the image controller is to receive second image data and is to transmit a control signal to the data driver to allow a transistor hysteresis reset signal to be transmitted to pixels of the display in the high grayscale region.

5. The display device as claimed in claim 1, wherein the image controller is to determine the pixels in the low grayscale region having grayscale values of no more than a predetermined threshold low grayscale for no less than the threshold time.

6. The display device as claimed in claim 1, wherein:

the data driver is to determine whether a predetermined output time has passed, and when the predetermined output time has not passed, the data driver is to transmit the transistor hysteresis reset signal to pixels in the low grayscale region.

7. The display device as claimed in claim 1, wherein the image controller is to:

analyze grayscale values of an image displayed in a region in which the same image is displayed for no less than the threshold time, and set a region in which displays the image having the grayscale values of no more than the threshold low grayscale value as the low grayscale region.

8. The display device as claimed in claim 1, wherein the image controller includes:

a first image processor to analyze the first image data to determine whether the same image is displayed for no less than the predetermined threshold time;

a second image processor to set a low grayscale region displaying an image having grayscale values of no more than the predetermined threshold low grayscale for no less than the threshold time, when the same image is displayed for no less than the threshold time; and a third image processor to transmit the control signal to the data driver to allow the transistor hysteresis reset signal to be transmitted to pixels in the low grayscale region.

9. The display device as claimed in claim 1, wherein the image controller includes a memory to store the threshold time, the threshold low grayscale, and the first image data.

10. A method for driving a display device, the method comprising:

receiving first image data;

analyzing the first image data to determine whether a same image is displayed for no less than a predetermined threshold time;

when the same image is displayed for no less than the threshold time, setting a low grayscale region displaying an image having grayscale values of no more than a predetermined threshold low grayscale value for no less than the threshold time;

receiving second image data; and transmitting a control signal to control transmission of a transistor hysteresis reset signal to only random ones of pixels in the low grayscale region.

11. The method as claimed in claim 10, wherein determining whether the same image is displayed for no less than a predetermined threshold time includes:

counting a number of vertical synchronizing signals; and determining that the same image is displayed for no less than the threshold time when the number of vertical synchronizing signals is no less than a predetermined number.

12. The method as claimed in claim 10, further comprising:

setting a high grayscale region displaying an image having grayscale values of no less than a predetermined threshold high grayscale for no less than the threshold time, when the same image is displayed for no less than the threshold time; and transmitting a transistor hysteresis reset signal to pixels in the high grayscale region.

13. The method as claimed in claim 10, wherein setting the low grayscale region includes determining pixels in the low grayscale region in which an image having grayscale values of no more than a predetermined threshold low grayscale is displayed for no less than the threshold time.

14. The method as claimed in claim 10, wherein transmitting of the transistor hysteresis reset signal includes:

determining whether a predetermined output time has passed; and transmitting the transistor hysteresis reset signal to pixels in the low grayscale region when the predetermined output time has not passed.

15. The method as claimed in claim 10, wherein setting the low grayscale region includes:

analyzing grayscale values of an image displayed in a region in which the same image is displayed for no less than the threshold time; and setting a region in which an image having grayscale values of no more than the threshold low grayscale is displayed as a low grayscale region.

16. A display apparatus, comprising:

a display panel comprising a plurality of pixels;

an image controller to identify a first grayscale region when a same image is output on a display for at least a predetermined time and to transmit a signal through the display panel to control transmission of a transistor hysteresis reset signal to only random ones of the pixels in the first grayscale region, to receive second image data, wherein the first grayscale region includes pixels that emit light with grayscale values in a first grayscale range having grayscale values less than or equal to a predetermined threshold low grayscale value.

17. The apparatus as claimed in claim 16, wherein the image controller is to identify a second grayscale region including pixels that emit light in a second grayscale range when the same image is output on the display for at least the predetermined time.

* * * * *